US010513890B2

(12) United States Patent
Verhoef et al.

(10) Patent No.: US 10,513,890 B2
(45) Date of Patent: Dec. 24, 2019

(54) TOOL AND METHOD FOR FACILITATING COMMUNICATION BETWEEN A COMPUTER APPARATUS AND A DEVICE IN A DRILL STRING

(71) Applicant: NATIONAL OILWELL VARCO UK LIMITED, Stonehouse (GB)

(72) Inventors: Richard Verhoef, Akkrum (NL); John Bradley Applewhite, Houston, TX (US)

(73) Assignee: National Oilwell Varco UK Limited, Gloucester (GB)

( * ) Notice: Subject to any disclaimer, the term of this patent is extended or adjusted under 35 U.S.C. 154(b) by 205 days.

(21) Appl. No.: 15/563,766

(22) PCT Filed: Mar. 21, 2016

(86) PCT No.: PCT/GB2016/050782
§ 371 (c)(1),
(2) Date: Oct. 2, 2017

(87) PCT Pub. No.: WO2016/162659
PCT Pub. Date: Oct. 13, 2016

(65) Prior Publication Data

US 2018/0073306 A1 Mar. 15, 2018

(30) Foreign Application Priority Data

Apr. 10, 2015 (GB) ..... 1506087.4

(51) Int. Cl.
*E21B 17/02* (2006.01)
*E21B 47/12* (2012.01)
*E21B 21/08* (2006.01)

(52) U.S. Cl.
CPC ..... *E21B 17/028* (2013.01); *E21B 17/023* (2013.01); *E21B 47/12* (2013.01); *E21B 21/08* (2013.01)

(58) Field of Classification Search
CPC .... E21B 17/028; E21B 19/165; E21B 17/023; E21B 47/12; E21B 21/08
See application file for complete search history.

(56) References Cited

U.S. PATENT DOCUMENTS 6,715,542 B2 4/2004 Mullins
6,722,425 B2 4/2004 Mullins
(Continued)

FOREIGN PATENT DOCUMENTS

EP 1819896 B1 4/2009
WO 2004/0033847 A1 4/2004
(Continued)

OTHER PUBLICATIONS

International Search Report and Written Opinion dated Jul. 8, 2016 for International Patent Application No. PCT/GB2016/050782, filed on Mar. 21, 2016.
(Continued)

*Primary Examiner* — Michael R Wills, III
(74) *Attorney, Agent, or Firm* — Amerson Law Firm, PLLC

(57) ABSTRACT

A top drive apparatus for facilitating communication between a computer apparatus and a device in a drill string, particularly, but not exclusively during tripping, the drill string comprising a pipe (13) having a threaded box end (140) and a pipe communication element (160) therein, the top drive apparatus comprising a top drive (30) having a main shaft (29) and a tool (101) rotationally fast therewith, the tool (101) comprising a threaded pin end (125) having a tool communication element (170) projecting therefrom,
(Continued)

such that in use the thread does not have to be made up to obtain a communication between the pipe communication element and the tool communication element, either by induction and most optionally a physical contact therebetween to provide an electrical contact therebetween.

26 Claims, 11 Drawing Sheets

(56) References Cited

U.S. PATENT DOCUMENTS

| | | | |
|---|---|---|---|
| 6,779,599 | B2 | 8/2004 | Mullins et al. |
| 7,096,948 | B2 | 8/2006 | Mosing et al. |
| 7,198,118 | B2 | 4/2007 | Hall et al. |
| 7,598,886 | B2 | 10/2009 | Hall et al. |
| 7,690,422 | B2 | 4/2010 | Swietlik et al. |
| 7,726,418 | B2 | 6/2010 | Ayling |
| 8,033,338 | B2 | 10/2011 | Springett |
| 8,115,495 | B2 | 2/2012 | Harmon |
| 8,286,728 | B2 | 10/2012 | Veeningen |
| 8,462,013 | B2 | 6/2013 | Hawthorn et al. |
| 8,631,822 | B2 | 1/2014 | Weir et al. |
| 8,791,832 | B2 | 7/2014 | Hawthorn et al. |
| 2006/0021799 | A1 | 2/2006 | Hall et al. |
| 2008/0165011 | A1 | 7/2008 | Staff |
| 2008/0202810 | A1* | 8/2008 | Gomez ..... E21B 47/0006 175/40 |
| 2010/0224409 | A1 | 9/2010 | Shardul et al. |
| 2010/0243324 | A1 | 9/2010 | Veeningen et al. |
| 2010/0243325 | A1* | 9/2010 | Veeningen ..... E21B 17/028 175/40 |
| 2013/0112428 | A1 | 5/2013 | Weir et al. |
| 2013/0199845 | A1 | 8/2013 | Zaleski, Jr. et al. |
| 2014/0144651 | A1 | 5/2014 | Lamik-Thonhauser et al. |

FOREIGN PATENT DOCUMENTS

| | | | |
|---|---|---|---|
| WO | 2014/0026038 | A1 | 4/2004 |
| WO | 2009/0098473 | A2 | 8/2009 |
| WO | 2009/0098474 | A1 | 8/2009 |
| WO | 2009/0098478 | A2 | 8/2009 |
| WO | 2009/0098482 | A1 | 8/2009 |
| WO | 2010/0089572 | A1 | 8/2010 |
| WO | 2010/0089573 | A1 | 8/2010 |

OTHER PUBLICATIONS

UK Search Report dated Jun 8, 2015 for Great Britain Application No. 1506087.4, filed on Apr. 10, 2015.

* cited by examiner

TOOL AND METHOD FOR FACILITATING COMMUNICATION BETWEEN A COMPUTER APPARATUS AND A DEVICE IN A DRILL STRING

BACKGROUND

The present invention relates to a tool and method for facilitating communication between a computer apparatus and a device in, on or near a drill string, particularly, but not exclusively while tripping drill pipe.

In the drilling of a borehole in the construction of an oil or gas well, a drill bit is arranged at a lower end of a drill string, which is rotated to bore the borehole through a formation. A drilling fluid known as "drilling mud" is pumped through the drill string to the drill bit to lubricate the drill bit and returns carrying drill cuttings in an annulus between an outer wall of the drill string and the borehole. As the drill bit progresses through the formation, stands of drill pipe are added to the drill string. Stands of drill pipe typically comprise two, three or four joints of drill pipe threadedly connected together in a mousehole in a drilling rig floor using an iron roughneck and set back in a fingerboard pipe rack. A joint of drill pipe is typically 31 ft 6 inches long (9.65 m). Each joint of drill pipe has a hollow cylindrical body with a lower threaded pin end and an upper threaded box end. As the drill bit progresses in the borehole, the drill string moves downwardly. When an upper end of the drill string nears the rig floor, a stand is pulled out of the fingerboard pipe rack. The top of the stand is placed in an elevator, and the lower end aligned with a top of the drill string at well centre. A lower threaded pin end of the stand of drill pipe is stabbed into an upper box of the drill string and threadedly connected using the iron roughneck. Drilling then continues using rotation of a top drive, a rotary table or downhole motor. The drill string can be many hundreds or thousands of metres long.

The drill string may be pulled out of the borehole for many reasons, such as: to change the drill bit; to allow for a string of casing to be lowered into the borehole for casing the borehole; to hang a liner; to set a whipstock for deviated drilling; to lower milling tools; to fish for stuck tools; to clean the borehole; and prepare the borehole for production. The step of pulling the drill string out of the borehole is known as "tripping-out" and the step of lowering the drill string back into the borehole is known as "tripping-in". During tripping, the string of drill pipe is not rotated or only rotated slowly in order to facilitate a smooth movement along a borehole, which may be deviated or partly horizontal.

As will be appreciated, as the drill string is pulled out of the borehole, a stand of drill pipe is disconnected using an iron roughneck and the stand placed back into the fingerboard pipe rack, usually using a pipe handling tool, such as a racker.

It is important to receive information from a multiplicity of downhole devices, such as downhole tools and sensors. Some examples are Measuring Whilst Drilling tools (MWD) and Logging Whilst Drilling tools (LWD) which are located in the Bottom Hole Assembly. Further data, such as temperature and pressure readings may be obtained from further sensors arranged on the Bottom Hole Assembly and along the length of the drill string. Generally, the more data that can be obtained from downhole, the greater the chances of constructing a successful well. Such modern tools and sensors create a lot of data. This data can be stored in a local data storage device, such as on a Random Access Memory (RAM) chip within the tool in the Bottom Hole Assembly, and physically brought back to the surface with the BHA in a trip. The RAM chip is physically plugged into a computer at the surface to obtain the data. Alternatively, the information can be accessed whilst the BHA remains at the bottom of the borehole. This can be achieved using wires which run along each joint of drill pipe, with special connectors provided to provide continuity of connection between each joint in the drill string. Such wired communication is provided by Intelliserv, a subsidiary of National Oilwell Varco. Thus information from downhole can be obtained in real time. The wired connection can also send instructions downhole to control downhole tools, measuring devices and sensors. Information may be sent along such a wired string during drilling using an Instrumented internal Blow Out Preventer (IIBOP), such as the IIBOP provided by National Oilwell Varco under the trade name String Sense™. The IIBOP provided with an upper box end, a lower pin end and a selectively open flow path there between, as with a standard Internal Blow Out Preventer. The upper box end is threadedly attached to a Main rotating shaft of the top drive, immediately below the top drive. The lower pin end is threadedly connected to a wired sub. The wired sub provides a continuous wired connection to the IIBOP when threadedly connected with the string of drill pipe in the borehole. A communication path is established across the String Sense™ IIBOP to a rotary connection, which transfers data to a rotationally stationary wire or wire bundle which is draped over the top drive and into a travelling loom to a computer in a driller's cabin, known as a dog house, on the drilling rig.

SUMMARY AND STATEMENTS OF EMBODIMENTS OF INVENTION

The inventors observed that a connection with downhole sensors, tools and measuring devices was lost during tripping and that it would be beneficial to have such connection to receive data and send commands in real time or as quickly as possible during tripping.

There is disclosed a top drive apparatus for facilitating communication between a computer apparatus and a downhole device in a drill string, the drill string comprising pipe having a threaded box end and a pipe communication element therein, the top drive apparatus comprising a top drive having a main shaft and a tool rotationally coupled therewith, the tool comprising a threaded pin end having a tool communication element projecting therefrom. Optionally, such that in use the threads of the pin end and box end does not have to be made up to obtain a communication between the pipe communication element and the tool communication element by induction and most optionally a physical contact therebetween to provide an electrical contact therebetween. Optionally, the tool communication element projects from the pin end at least between 5 mm, optionally at least 10 mm and most optionally by at least 100 mm. It is preferable that the communication element projects by no more than 1000 mm and optionally, no more than 500 mm and most optionally by no more than 200 mm.

Optionally, the tool further comprises a resilient member arranged to bias the tool communication element away from the pin end. Optionally, such that in use the tool communication element contacts the pipe communication element in the box end of a pipe in the drill string to maintain a predetermined pressure. Optionally, the resilient member is a coiled spring, although may be a pneumatic cylinder, accumulator, Bellville washer, rubber annular member etc.

Optionally, the tool communication element is arranged on a stinger having a flow bore for allowing drilling mud to flow therethrough. Optionally, the stinger takes the form of a solid wall cylindrical sleeve and optionally is concentric with the flow bore of the pin and and optionally slides within the bore of the pin end. Optionally, the stinger has a flange, such as a downwardly facing shoulder, with the tool communication element arranged therein. Optionally, the stinger has a lower portion insertable into the flow bore of an upset portion of the box end. Optionally, the lower portion facilitates alignment of the flange and hence the communication element on to the pipe communication element in the box end of the pipe.

Optionally, the stinger comprises at least one seal for inhibiting drilling mud escaping the flow bore between the stinger and the box end of the pipe. Optionally, the seal is an axial seal. Optionally, the axial seal is arranged on the flange and optionally arranged to seal about or within the pipe communication element. Optionally, the seal is resilient and may be an elastomeric seal.

Optionally, the seal is an annular seal. Optionally, the annular seal is one of: a V-type seal; a packer type seal which optionally expands on entering the flow bore of the pipe; and an O-ring type seal. Optionally, the peal is rated to 350 bar (5,000 psi) to be sufficient for drilling mud to be circulated through the stinger and the drill string.

Optionally, the tool further comprises a pressure release means for allowing air into the flow bore when pressure therein is lower than atmospheric pressure. Typically, when there is drilling mud is hydraulically locked in the flow bore and has not had a chance to flow down and settle at its natural head in the drill string, surplus drilling mud hydraulically locked in the stand of pipe can unintentionally flow out on to the rig floor. The pressure relief valve inhibits this from occurring, inhibiting hydraulic locks in the flow bore.

Optionally, the tool communication element is retractable relative to the pin end. The tool communication element may be fully retractable into the pin end or retractable relative to pin end, but remains projecting from the pin end at all stages of operation.

Optionally, the tool has a load path therethrough which takes the full weight of the drill string which is typically in the order of 500 to 1250 tons (450 to 1,130 tonnes), the load path optionally including the threaded connection. Optionally, the tool has a torque path therethrough for transferring or resisting torque between the main rotor of the top drive and the drill string. The torque path optionally including the threaded connection. Thus the tool takes and transfers the full torque provided by the top drive, without need of a pipe gripper. Full torque may be in the order of 75,000 ft lbs (102,000 Nm). This may be useful in rotating the entire drill string for drilling, well control situations and in torquing threaded connections.

Optionally, the tool further comprises a tube and a sleeve telescopically slideable relative to one another, the pin end depending from the sleeve, the tube and sleeve providing a flow path between the main shaft and the drill string. Optionally, the tube and sleeve have a shoulder therebetween for transferring a load. Optionally, the load is the entire weight of the drill string. Optionally, the tube and sleeve have at least one spline therebetween for transferring torque. Optionally, the torque is sufficient to spin a joint, optionally to torque a joint, optionally turn the entire drill string and optionally to take the full torque provided by the top drive against a fixed drill string, typically 75,000 ft lbs (102,000 Nm). Optionally, seals are provided between the tube and the sleeve. Optionally, the seals are rated to at least 700 bar (10,000 psi.

Optionally, the tool further comprises an axial retraction and/or extension apparatus to move the pin end relative to the top drive. Optionally, the axial retraction apparatus is arranged between an upper flange fixed to One of the tube and sleeve and a lower flange fixed to the other of the tube and sleeve. Optionally, the axial retraction apparatus is arranged between upper and lower stators. More optionally, the stators are fixed with upstands to a stator part of the top drive apparatus. Optionally, the upper stator comprises an upper collar, the tube rotatably arranged therein. Optionally, cylindrical roller hearing, rollers or cam followers are arranged between the tube and the upper collar. Optionally, the tube is provided with an upset portion with an annular groove therein, in which the cylindrical roller bearing, rollers or cam followers run.

Optionally, the lower stator comprises a lower collar the sleeve rotatably arranged therein. Optionally, cylindrical roller bearing, rollers or cam followers are arranged between the sleeve, and the lower collar. Optionally, the sleeve is provided with an upset portion with an annular groove therein, in which the cylindrical roller bearing, rollers or cam followers run. Optionally, the axial retraction apparatus comprises a piston and cylinder. Optionally, the piston and cylinder is hydraulically actuable and optionally comprises an accumulator. Optionally, the piston and cylinder is dual acting to allow retraction and extension. Optionally, a pair of piston and cylinders is provided. Optionally, the axial retraction apparatus is pneumatically operable, such as a pneumatic piston and cylinder; magnetically operable, such as a linear magnetic actuator; or mechanically operable, such as a screw actuator or scissor jack.

Optionally, the tool further comprises a wireless transmitter and/or receiver wired to the tool communicating element for facilitating transmission and/or reception of data from the computer to and/or from the drill string. Thus communication signals can be sent wirelessly between the computer and the tool. Optionally, the wireless transmitter and/or receiver is arranged in a sub, ISub, IBOP or IIBOP and the tool has a wire running therethrough from the tool communication element to a top communication element in a box in a top of the tool to provide a wired connection to the sub, ISub, IBOP or IIBOP. Further to a wireless communication, it may be possible to use a properly zone rated Inductive Slip ring for allowing to transfer data while rotating.

Optionally, the top drive apparatus further comprises a stabbing guide, optionally arranged about the pin end of the tool. Optionally, the stabbing guide comprises a frustoconical guide surface.

Optionally, the pipe is drill pipe. Optionally, the pipe is wired. Optionally, the drill pipe in the drill string is of the type available from Intelliterv, a National Oilwell Varco company. Each joint of pipe may comprise a communication ring in the box and in the pin end with a wire running therebetween. The drill string may further comprise a communication signal repeater or booster sub every few lengths of pipe, optionally every 450 m to boost the signal. Optionally, the pipe communication element is a ring. Although may be one or more segments of a ring.

Optionally, the tool communication element is a ring. Although may be one or more segments of a ring. Optionally, the tool communication element and the pipe communication element physically meet and have a force of approximately 90 Kg (200 lbs) applied therebetween, which optionally is initially applied by the action of the axial retraction and/or extension apparatus and optionally maintained by the resilient mean.

Optionally, a box end is arranged at the top of the tool. Optionally, the top drive apparatus further comprises a further tool communication element and a wire between the tool communication element and the further tool communication element for facilitating communication therebetween, along the length of the tool.

Optionally, the top drive apparatus further comprises an Internal Blow out Preventer between the main rotor and the tool. Optionally, a sub is arranged between the IBOP and the tool. Optionally, the IBOP is replaced with an Instrumented Internal Blow Out Preventer (IIBOP/String Sense) which may receive and relay communication signals from the drill string through the tool of embodiments of the invention. Optionally, the sub is an Instrumented sub, which may receive and relay communication signals from the drill string through the tool of embodiments of the invention. The tool of embodiments of the invention may be connected and depend from either the IBOP, IIBOP or the sub or ISub.

Optionally, the drill string comprises a multiplicity of joints of drill pipe. Optionally, the drill string comprises a multiplicity of sections of casing. In particular, a borehole may be drilled with casing instead of drill pipe. Casing is usually manufactured with a pin end on each end and a coupling placed on one end before it is brought to the drill floor. Thus the pin end with the coupling forms a box end. The casing will be arranged with the box end at the top of the drill string so that a pin end of a following section can be stabbed into the box, in the same way as for drill pipe tripping and drilling. Casing is usually added in singles rather than stands.

Optionally, the drill string may comprise joints of tool string. The tool string may comprise joints of pipe which are not suitable for drilling, but are suitable for moving tools in and out of boreholes and thus need to be tripped-in and tripped-out of the borehole.

Optionally, the threaded pin end has at least one sealing surface, such that when threaded into the box end of a the drill string, a seal is formed which optionally maintains a seal up to at least 700 bar (10,000 psi).

There is also disclosed a tool for use in the top drive apparatus of embodiments of the invention comprising a threaded pin end having a flow bore therethrough and a tool communication element projecting from the threaded pin end.

Optionally, the tool further comprises a resilient member arranged to bias the tool communication element away from the pin end. Optionally, the tool communication element is arranged on a stinger having a flow bore for allowing drilling mud to flow therethrough. Optionally, the stinger has a flange, the tool communication element arranged in the flange.

There is also disclosed a tool comprising a threaded pin end having a flow bore therethrough and a tool communication element projecting from the threaded pin end. The tool may be used in a rotary table rig without a top drive. Instead the tool is optionally used with a swivel, which optionally is a rotary swivel and may be provided with a goose neck for circulating drilling mud.

There is also disclosed a method for facilitating communication along a drill string during tripping, the method comprising the steps of moving a pin end towards a box end of a drill string comprising a box end with a pipe communication element therein, the pin end having a tool communication element projecting therefrom and transferring data between the pipe communication element and the tool communication element without making a threaded connection therebetween.

Optionally, the tool communication element is fixed to a stinger which is axially movable relative to the pin end, the method further comprising the step of circulating mud through the stinger and the drill string.

Optionally, in a well control operation or a drilling operation, the pin end is made up to the box end of the drill string. Communication between the computer and the drill string can thus continue. A well control situation may be expected or unexpected. A rise in pressure in the drilling mud is usually the first sign of a well control situation. The driller or tool pusher will thus have time to make up the connection and to pump high density mud into the drill string and to activate the IBOP or IIBOP if necessary to inhibit drill mud from rising through the drill string and causing an overflow situation in the active mud system. Optionally, the method comprises the step of hanging the drill string from the tool. Thus the tool takes the full weight of the drill string which could be in the order of 500 to 1250 tons (450 to 1,130 tonnes), taken through a load path in the tool. Optionally, the method comprises the step of rotating the tool in concert with the main rotor, the drill string rotating transferring torque provided by the top drive to the drill string threaded to the tool. Thus the tool takes and transfers the full torque provided by the top drive, without need of a pipe gripper. Full torque may be in the order of 75,000 ft lbs (102,000 Nm). This may be useful in rotating the entire drill string for drilling, well control situations and in torquing threaded connections. Optionally, upon pin end being made up into the box end, the tool communication element moves towards the pin end. Optionally, when the tool communication element is arranged on a stinger, at least part of the stinger retracts into the pin end upon pin end being made up into the box end.

It will be appreciated that the term wired drill string used herein means a drill string having a physical communication path along the each section of pipe, physically connected to an adjacent section of drill pipe at the pin/box juncture. Alternatively, or additionally, the drill pipe may include repeaters which send a wave generated signal through the pipe itself or the medium in the pipe, such as drill mud. Such repeaters may be arranged in the box end or pin end of each section of pipe WO 2004/033847. It will be appreciated that an object of embodiments of the invention is to maintain a communication path with the drill string and computers on the drilling rig, dog house or distant control centre during tripping.

Optionally, the pin end is threaded, such that a fluid tight connection can be made into a threaded box end of the pipe. Optionally, the threaded connection is rated to at least 700 bar (10,000 psi)

BRIEF DESCRIPTION OF THE DRAWINGS

For a better understanding of the present invention reference will now be made, by way of example only, to the accompanying drawings, in which.

DETAILED DESCRIPTION

Figure 1A:
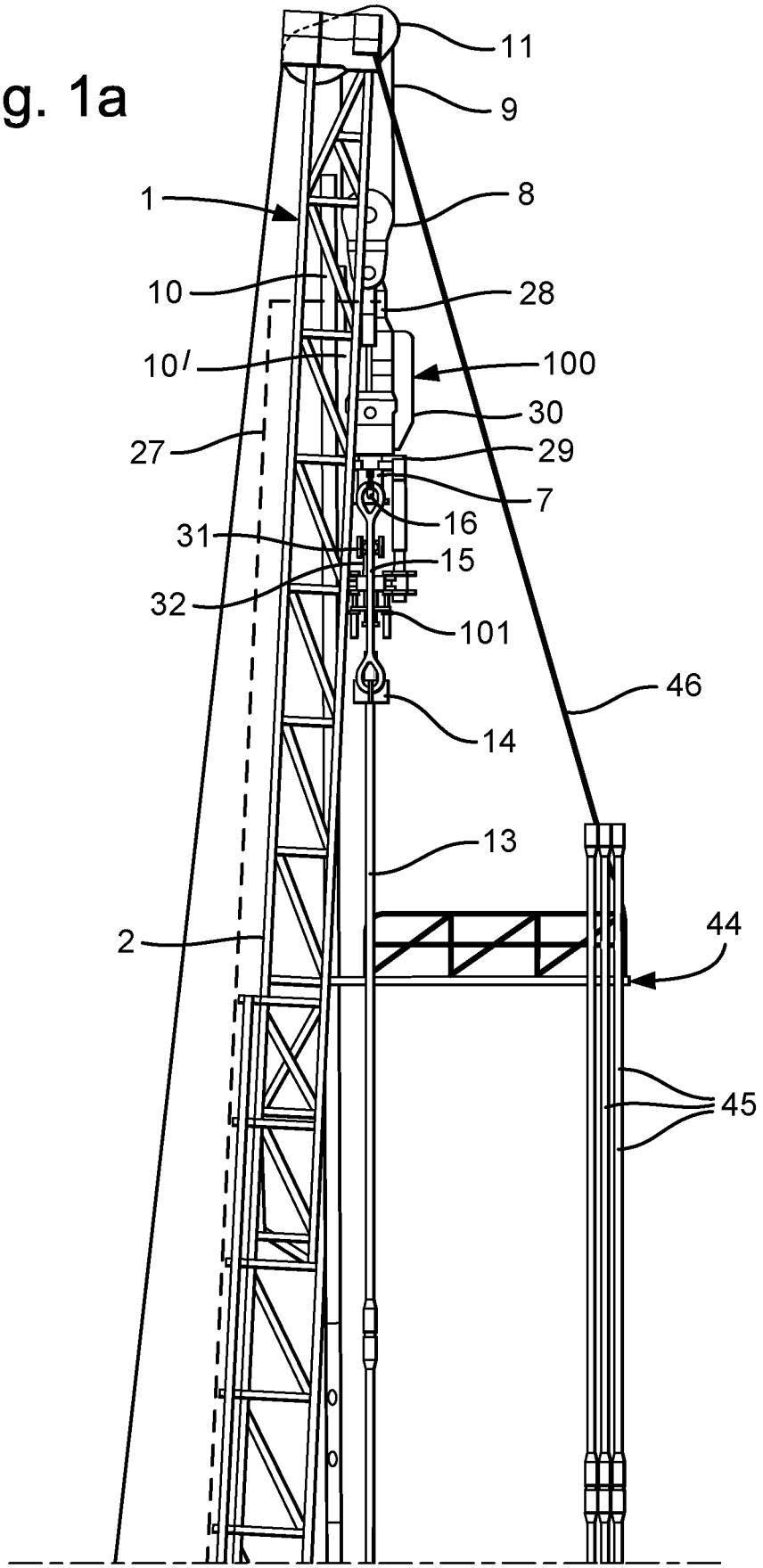
FIGS. 1A and 1B show a schematic view of a drilling rig having a top drive apparatus in accordance with an embodiment of the invention.
Figure 1B:
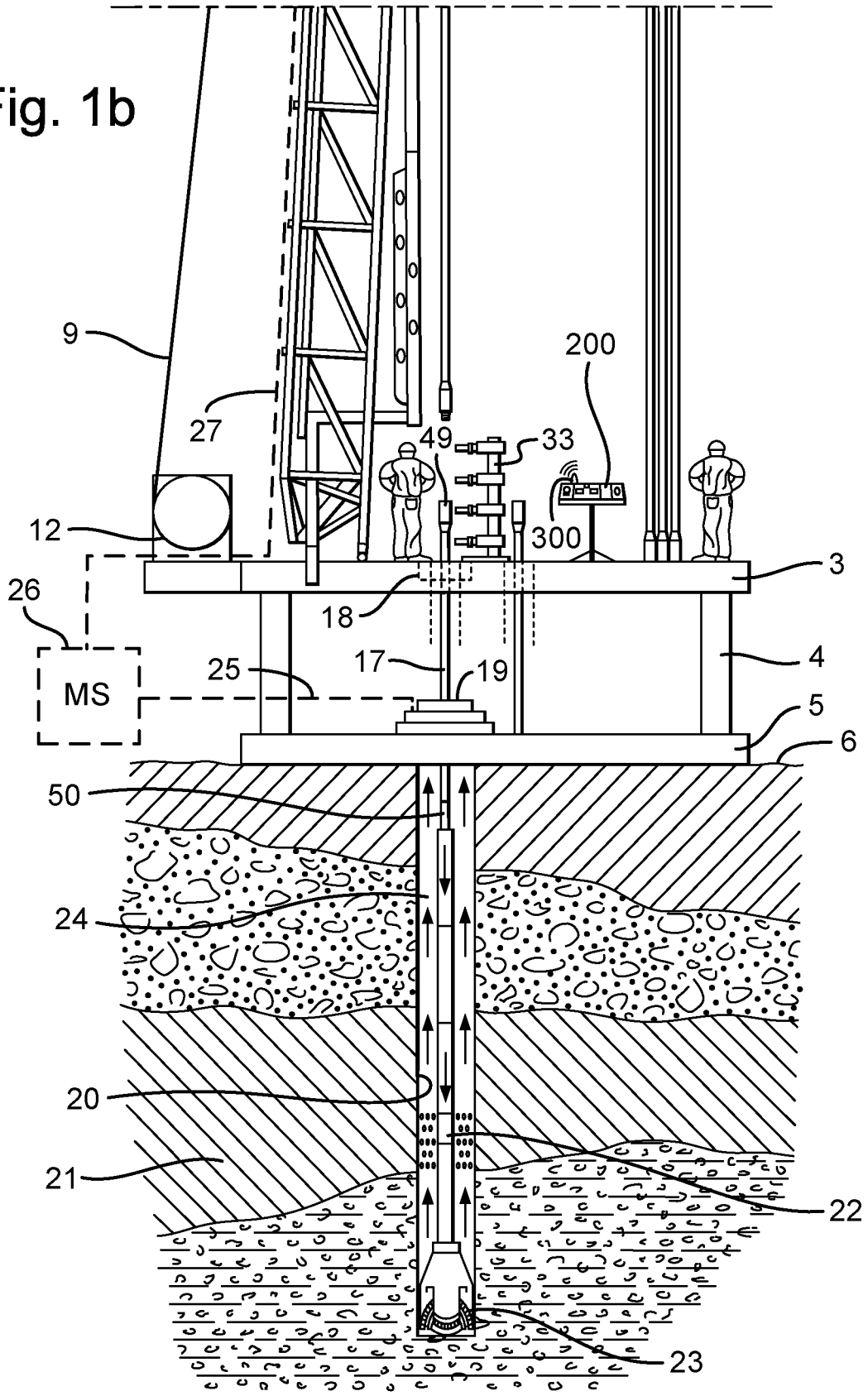

Referring to FIGS. 1*a* and 1*b* there is shown a drilling rig generally identified by reference numeral 1. The drilling rig 1 has a derrick 2 arranged on a drill floor 3 supported on legs 4. The legs 4 are seated on a substructure 5 on ground 6.

A top drive apparatus 100 is raised and lowered on a travelling block 8 on wireline 9 on a carriage 10' along a vertical track 10. The wireline 9 passes over a crown block 11 located at a top of the derrick 2 and down to a drawworks 12 on the rig floor 3 for reeling the wireline line 9 in and out. A stand of wired drill pipe 13 depends from an elevator 14. The elevator 14 depends from links 15 which are looped over ears 16 of a swivel 7 of the top drive apparatus 100.

A drill string 17 passes through a spider 18 in the drill floor 3, through a wellhead 19 into a bore hole 20 in formation 21. A bottom hole assembly 22 is arranged on a lower end of the drill string 17, which has a drill bit 23 on the lower end thereof. An annulus 24 is defined between the borehole 20 and the drill string 17.

A flow line 25 is fluidly connected at one end to the annulus 24 at the wellhead 19 and the other end to an active mud system 26. Returned drilling mud M flows from the annulus 24, through wellhead 19, into flow line 25 and to the active mud system 26. The active mud system 26 comprises a trip tank, an active mud tank and a series of pieces of mud processing equipment, such as: a shale shaker, a degasser, a mud conditioner, and a centrifuge. Processed drilling mud is pumped from the active mud system 26 through a hose 27 to a goose neck connection 28 on a top drive 30 of the top drive apparatus 100 to allow processed drilling mud to flow into a main rotating shaft 29 of the top drive 30. The drilling mud continues to flow through an Intelligent Internal Blow Out Preventer (IIBOP) 31 and/or Intelligent Sub (ISub) 32, through a connected while tripping tool 101 of an embodiment of the invention and on into the drill string 17 when connected.

An iron rough neck 33 is arranged on the rig floor 3 for rotating the stand of wired drill pipe 13 relative to the static drill string 17 to thread the stand of wired drill pipe 13 to the drill string 17 or unthread the stand of wired drill pipe 13 from the drill string 17.

The top drive apparatus 100 thus comprises a top drive 30, and items such as the swivel 7, links 15, IIBOP, ISub and the connected while tripping tool 101 and elevator 14. A suitable top drive 30 is available from the National Oilwell Varco TDX™ range of top drives.

Figure 2:
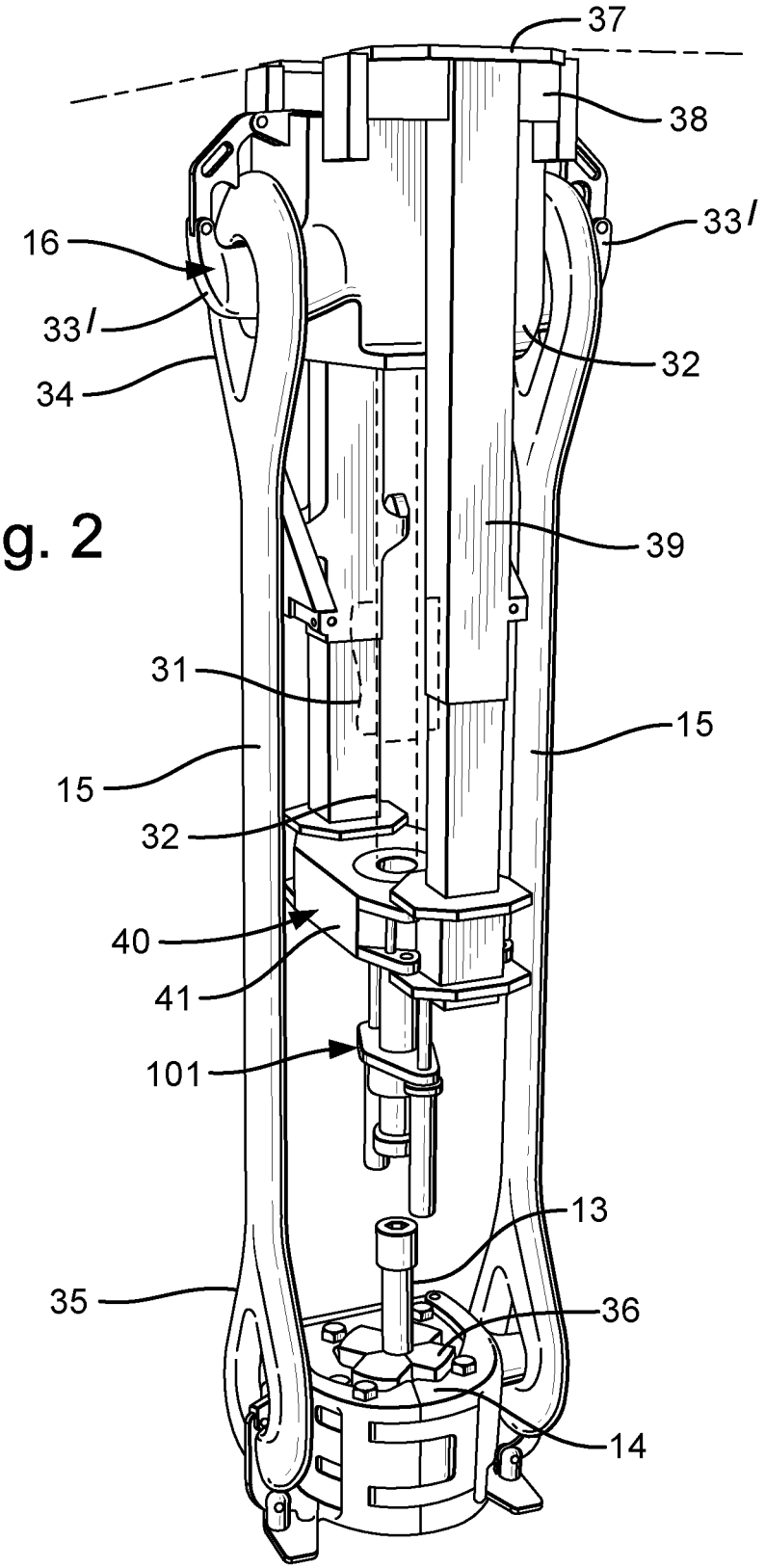
FIG. 2 is a perspective view of part of the top drive apparatus shown in FIG. 1 comprising an embodiment of a connected while tripping tool of the invention.

A part of the top drive apparatus 100 is shown in more detail in FIG. 2. The swivel 16 comprises a main body 32 having a pair of ears 33', each one on an opposing side of the main body 32. Each link 15 has a top eye 34 looped over respective ear 33'. Each link 15 also has a bottom eye 35 from which is hung the elevator 14. The elevator 14 comprises slips 36 which are hydraulically actuated to selectively grip the wired drill pipe 13. A suitable elevator 14 is available from National Oilwell Varco under the trade name BX™ elevators, such as the BX-7™ elevator. The weight of the wired drill pipe 13 is carried through a load path which includes the elevator 14, the links 15 and the swivel 16. When the wired drill pipe 13 is connected to the drill string 17 therebelow, the full weight of the drill string 17 will be held through this load path, which could be in the order of 500 to 1250 tons (450 to 1,130 tonnes).

The swivel 16 has a stator 37 which is fixed to a rotationally static part of the top drive 30 and/or a carriage 10'. The main body 32 is fixed or may be selectively rotatable about the stator 37, with an axis of rotation about the main rotor 29. The swivel 16 may thus comprise a motor (not shown) within the main body 32 to selectively rotate the main body 32 with respect to the stator 37, which allows, for example, rotational orientation of the links 15. A collar 38 is fixed to a top of the main body 32, which has a pair of telescopic legs 39 depending therefrom. A pipe gripper 40 is fixed to lower ends of the telescopic legs 37. The pipe gripper 40 selectively grips a tubular or a tubular part of a tool. The gripper 40 may be used as a back-up tong for use in the connection and disconnection of tubular items depending from the main rotor 29, such as an IIBOP 31 (shown in dashed lines), ISub 32, saver subs, the connected while tripping tool 101 etc. The torque for such connections and disconnections may be provided by the top drive 30 rotating main rotor 29 or using an iron rough neck 33 on the rig floor 3. The telescopic legs 37 are of box section, which facilitate transfer of resisting torque to the collar 38 to the carriage 10' or rotationally static part of the top drive 30. The pipe gripper 40 is vertically movable relative to the swivel 16 by extending and retracting the telescopic legs 39. The pipe gripper 40 has at least one door 41 to allow the gripper 40 to move up and down over large diameter tools, such as an IIBOP 31 and communication while tripping tool 101.

Referring to FIGS. 3 to 6, the communication while tripping tool 101 has a box 102 having a female thread 103 for connection with a threaded pin (not shown) of an ISub 32 and depends therefrom. Thus the communication while tripping tool 101 rotates in concert with the main rotor shaft 29 of the top drive 30.

The communication while tripping tool 101 comprises a tube 104 depending from the box 102, which is optionally integral therewith. The tube 104 has an inner Surface defining a flow bore 105 which has a cross-sectional area substantially equal to the cross-sectional area of flow bore 106 in the wired drill pipe 13. The tube. 104 has a smooth exterior surface 107 having at a lower end, an outwardly extending shoulder 108 having a plurality of recesses with O-ring seals 109 therein.

A sleeve 110 has a smooth inner surface 111 having a top end with a female thread 112 with a cap 113 having an external thread threadedly engaged therein. The cap 113 is locked in sleeve 110 with a locking pin (not shown) to inhibit relative rotation therebetween. The cap 113 has an internal surface provided with a plurality of recesses with O-ring seals 114 therein. The smooth inner surface 111, shoulder 108, smooth outer surface 107 and an end 115 of the cap 113 define an annulus 116. When the sleeve 110 is fully extended relative to the tube 104, the shoulder 108 and end 115 abut, creating a load path. The load path maybe sufficient to withstand the entire weight of a drill string 17 is threadedly connected to the tool 101.

The cap 113 has an integral flange 117 to which two cylinders 118 of respective rams 119 are fixed. Each ram 119 has a cylinder 118 depending from the flange 117 with a piston rod 120 extending through the flange 117 to abut and are fixed to an upper flange 121. The upper flange 121 extends outwardly from a top of the tube 104 at a base of the box 102. The rams 119 are double acting and have nipples (not shown) at the top and bottom of the cylinder 118, which are connected to a hydraulic supply via a rotary coupling (not shown) in the ISub 32 or at a top of the tube 104 below the box 102. Hydraulic lines (not shown) and connected to a static part of the rotary coupling to convey hydraulic fluid to and from the rams 119 of the communication while tripping tool 101. The rams 119 create a load path. The load path maybe sufficient to withstand the weight of a stand of drill pipe and may withstand the entire weight of a drill string 17 is threadedly connected to the tool 101.

A CWT pin end 125 is fixed to a lower end of the sleeve 110. The CWT pin end 125 is shown in greater detail in FIG. 6. The CWT pin end 125 has an upper threaded end 129*b* threaded and rotationally locked into the lower end of the sleeve 110. The CWT pin end 125 has an upper portion 126 with an internal diameter which is slightly larger than the internal diameter of the wired drill pipe 13. The CWT pin end 125 has a lower portion 127 with an internal diameter which is substantially the same as the internal diameter of the wired drill pipe 13. The CWT pin end 125 has a shoulder 128 formed between the upper portion 126 and lower portion 127. The lower portion 127 also has a tapered external surface provided with a male thread 129.

A stinger 130 is slideably arranged in the CWT pin end 125 against a coiled spring 131. The stinger 130 takes the form of a sleeve slideably projecting from the end of the pin end 125. The stinger 130 has an upper end having an outwardly projecting shoulder 132, which abuts and slides along the internal surface of the upper portion 126 of the CWT pin and 125. The upper end also has an internal recess 133 for receiving the coiled spring 131. A lower end 134 of the stinger 130 has an inner diameter which is slightly smaller than the internal diameter of the wired drill pipe 13. The lower end 134 has an upper shoulder 135 at a base of the internal recess 133 against which a lower end of the coiled spring 131 is biased. An end cap 136 is fixed to the top of the pin end 125, against which an upper end of the coiled spring 131 is biased. The end cap 136 has a central opening therein which is of similar diameter to the internal diameter of the lower end 134 of the stinger 130 to allow fluid to flow therethrough. The lower end 134 of the stinger 130 has a flange 137.

Figure 7:
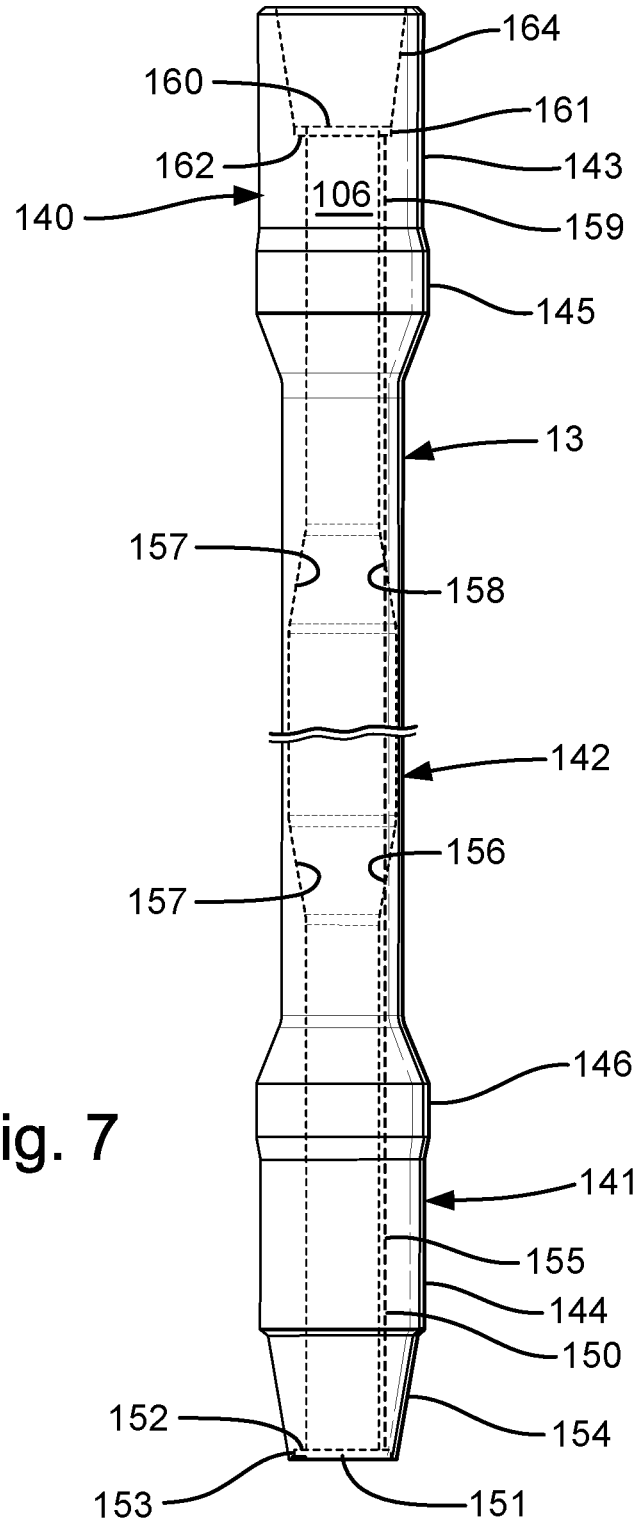
FIG. 7 is a side schematic view of the box end and pin end of a joint of wired drill pipe shown in FIGS. 1A and 1B.

Referring to FIG. 7, there is shown the box end 140 and a pin end 141 of a joint of wired drill pipe 13. A body 142 of the drill pipe 13 extends between the box end 140 and pin end 141, which has an outer diameter and the box end 140 and 141 have respective enlarged upset portions 143 and 144. The body 142, the box end 140 and the pin end 141 are typically machined from one piece of steel, usually mild steel, but may be a stainless chromium steel or the like. Each enlarged upset portion 143 and 144 may have a hardfaced band 145 and 146 thereabout to inhibit wear on the enlarged upset portions 143 and 144 which may be caused by rubbing against an inner wall of the open borehole 20 or the inside wall of a cased borehole (not shown) when in use. A communication or power wire 150 passes through the length of the drill pipe 13 from a communication ring 151. The communication ring 151 may be electrically isolated from the metallic pin end 141 and arranged in a groove 152 in an end face 153 of an externally threaded portion 154 of the pin end 141. The communication ring 151 may have an insulation layer (not shown) within the groove to inhibit transfer of an electrical communication signal passing to the metal drill pipe 13. The wire 150 may also be insulated with one or more surrounding layers to inter alia, inhibit line loss and provide physical protection for the conducting wire, typically a copper or silver core. The wire 150 passes through a hole 155 in the enlarged upset portion 144 and exits into the flow bore 106 at an opening 156 located where an internal surface 157 tapers into the main body 142 of the drill pipe 13. The wire 150 may then pass freely through the flow bore 106 to an opening 158 located where the internal surface 157 tapers to a smaller diameter at the enlarged upset portion 143 of the box end 140. The wire 150 passes through the opening 158 through a hole 159 to a communication ring 160 arranged in a groove 161 in a shoulder 162 forming the internal base of an internally threaded portion 164. The communication ring 160 may be electrically isolated from the metallic box end 140 and may have an insulation layer (not shown) within the groove 161 to inhibit transfer of an electrical communication signal passing to the metal drill pipe 13. The communication ring 160 may have an open upper face for abutting a communication ring 151 of a pin end 141 of an adjacent drill pipe (not shown) to obtain a physical electrical contact therebetween to allow a communication signal to pass thereacross. Alternatively, the communication ring 160 may have an open upper face for allowing a communication ring 151 of a pin end 141 of an adjacent drill pipe (not shown) to be close to, but not have a physical touching electrical contact therebetween, but will allow a communication signal to pass or jump thereacross by induction or other means.

A repeater sub 50 is installed in the drill string 17 optionally every 450 m, although may be every 100 m to 2 km to boost the communication signal running along the wired drill pipe. In this way, the voltage and power transfer along the wired drill pipe can be maintained at a low level to allow its use in a potentially explosive environment, particularly, but not exclusively when drilling for gases, in multiphase wells and in oil producing wells in which there are likely to be bubbles of gazes.

Referring back to FIG. 6, the external thread 129 of the CWT pin end 125 is shown threaded into the box end 140 of wired drill pipe 13. The outer edge of the flange 137 of stinger 130 is substantially the same diameter as the internal diameter of the base 162 of the internally threaded portion 164 of the box end 140. The flange 137 has a CWT communication ring 170 in a lower face of the flange 137.

The stinger 130 has a lower stinger portion 180 which slides concentrically into the flow bore 106 of the box end 140 of the wired drill pipe 13. The flange 137 and/or the lower stinger portion 180 is provided with a seal for inhibiting drilling fluid from escaping when drilling fluid is circulating through the drill string 17. Thus the seal is sufficient to allow circulation of drilling mud through the drills string, typically at a pressure of up to 5000 psi (350 bar).

A seal arrangement 175 may be provided for a seal between the flange 137 and the box end 140. The seal may be an axial seal acting between a lower face of the flange 137 and the shoulder 162 located at the base of the internal thread 164. A cup seal may be a suitable seal. Alternatively, the seal arrangement 175 may seal between a side face of the flange 137 and the internal thread 164 of the box end 140. A cup seal may be a suitable seal.

A seal arrangement 190 may be provided for an annulus between the lower stinger portion 180 and an internal surface of the wired drill pipe 13. Such a seal may be an annular V-type seal arranged to seal against drilling mud escaping therebetween, but allowing air to enter the flow bore 106 of the drill pipe 13 if fluid pressure in the flow bore is lower than ambient, for example if the drill pipe 13 contains drilling fluid under an airlock. The V-type seal allows air to flow into the top of the drill pipe to allow drilling fluid to flow back into the drill string and will inhibit drilling mud locking in the drill pipe and then suddenly flooding on to the drill floor during tripping out.

In use, the communication while tripping (CWT) tool 101 may be used in the flowing way.

Figure 3:
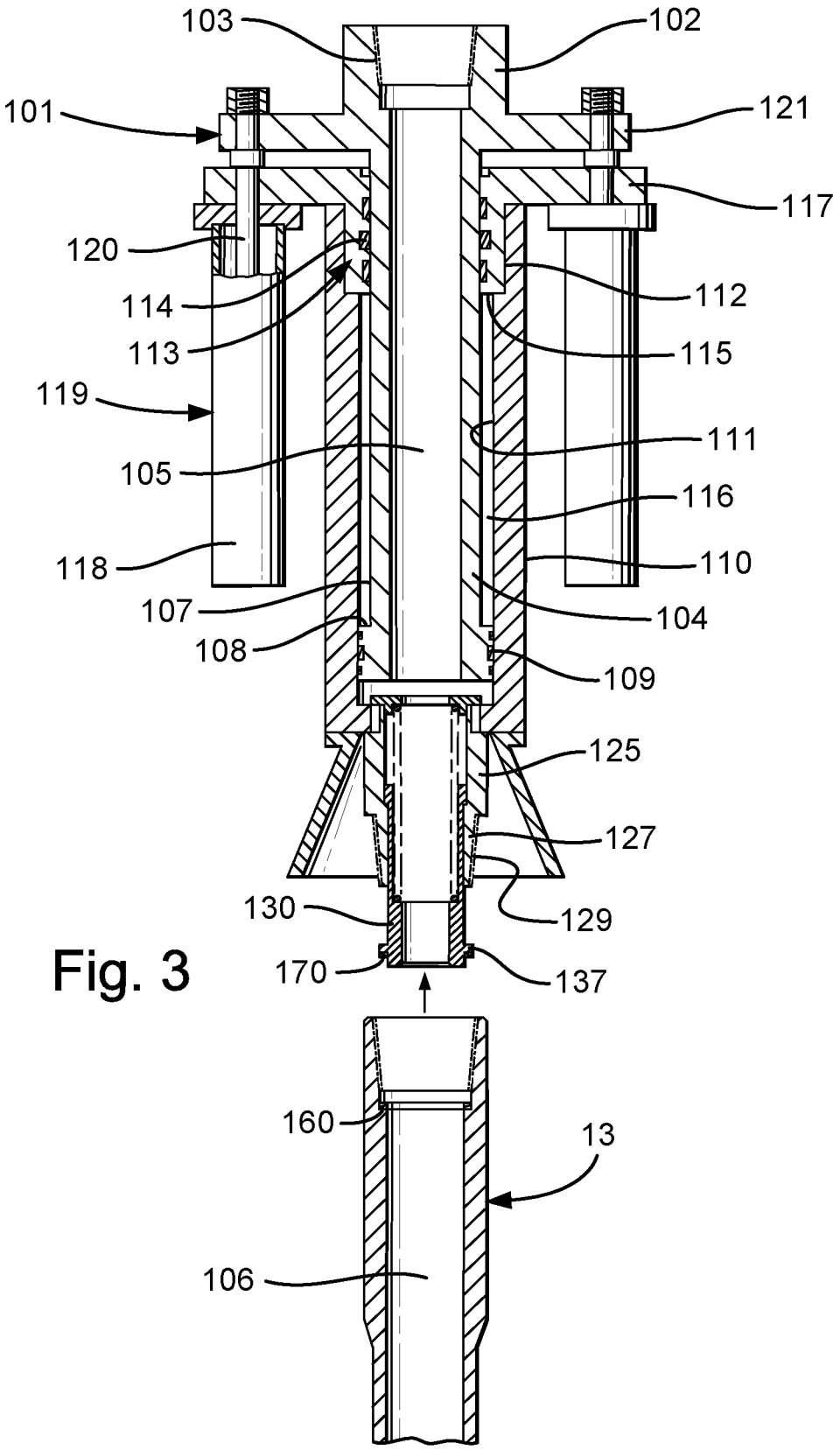
FIG. 3 is a side view in cross-section of the communication while tripping tool shown in FIG. 2, in an inoperative position above a box of a wired drill string.
Figure 4:
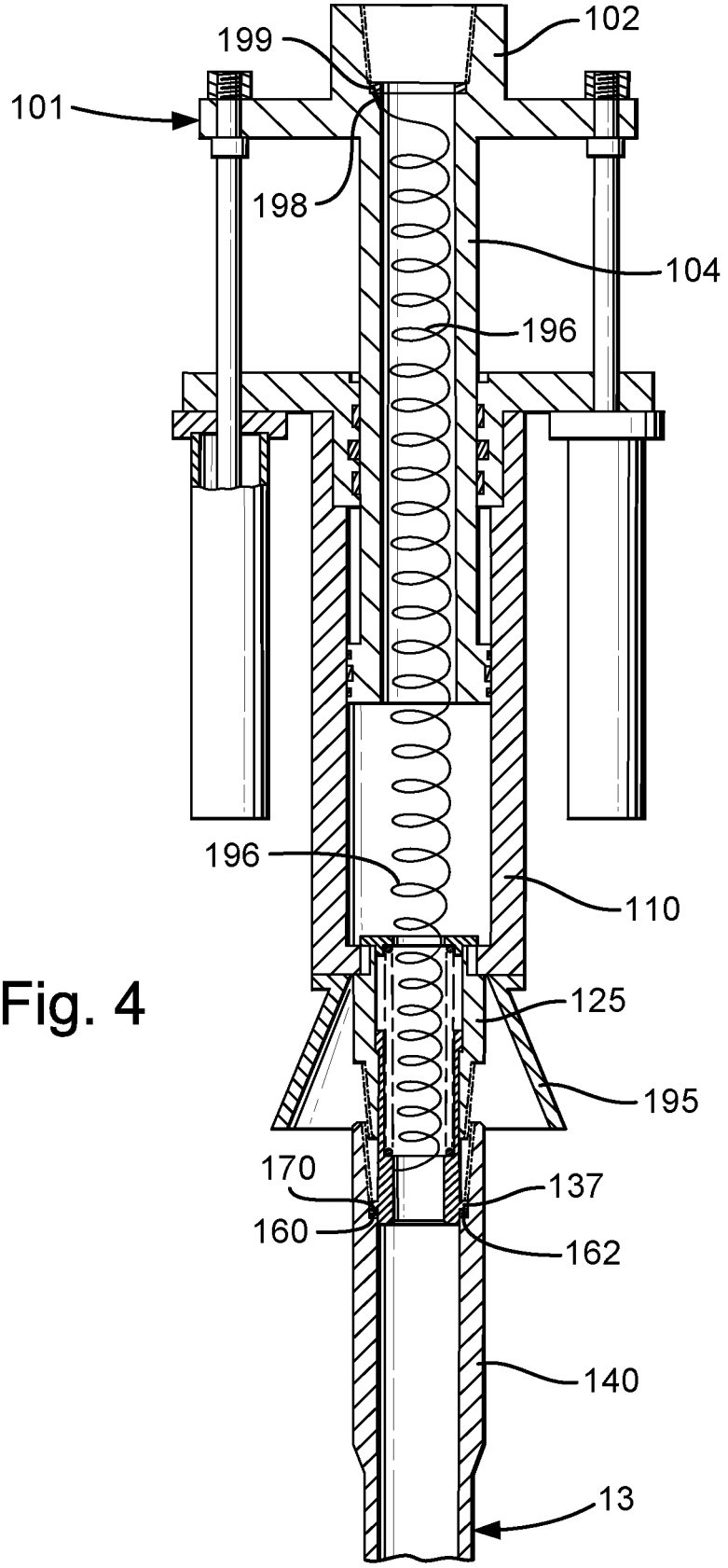
FIG. 4 is a side view in cross-section of the communication while tripping tool shown in FIG. 2, in am engaged position in which a communication connection made with the wired drill string.

During tripping out when communication along the drill string 17 is desired, the top drive apparatus 100 is lowered along the track 10 until the elevator 14 is at a level below the box end 140 of the drill string 17 projecting as a stem through the spider 18 in the drill floor 3. The hydraulically activatable slips 36 in the elevator 14 are set around the stem. The communication while tripping tool 101 is now in an inactive position as shown in FIG. 3. The communication while tripping tool 101 is activated by flowing hydraulic fluid into a lower chamber of the rams 119 to assume an engaged position shown in FIG. 4. The sleeve 110 moves downwardly along tube 104 until the CWT communication ring 170 in the flange 137 abuts the communication ring 160 in the shoulder 162 at the base of the internal threaded portion 164 of box end 140 and a contact force is applied. The force is optionally 90 kg (200 lbs) although may be in the region of 1 kg to 1000 kg. A frusto-conical stabbing guide 195 may facilitate the CWT pin end 125 being guided in line with the box end 140 of the drill string 17. The spring 131 absorbs any impact created when the flange 137 meets the shoulder 162. The spring 131 also facilitates a constant force between the CWT communication ring 170 in the flange 137 and the communication ring 160 in the shoulder 162, facilitating a communication path thereacross. A stable communication path is now established between the drill string 17 and the communication while tripping tool 101. A CWT wire 196 is electrically connected at a lower end, optionally using a compression fitting, soldering or continuous crystalline connection to the CWT communication ring 170. The CWT cable passes through a hole 198 in the stinger 130 and passes into the flow bore 105. The CWT cable is coiled therein to allow for extension and contraction of the sleeve 110 relative to the tube 104. An upper end of the CWT cable passes through a hole 198 in the CWT box end 102 to an upper CWT communication ring 199, which allows a signal to pass on to the ISub 32 or IIBOP 31 which passes on any signals obtained from the wired drill string 17 to a computer 200 on the rig floor 3.

The drawworks 12 is activated to reel in line 9, raising the top drive apparatus 100 along track 10, lifting the elevator 14 and the drill string 17 held therein. When a stand of drill pipe is above the spider 18, the top drive apparatus is lowered a little, setting the drill string 17 in the spider 18 and releasing the slips 36 in the elevator 14. The spring 131 will be compressed as the top drive apparatus moves downwardly relative to the drill string and/or the rams 119 retract slightly or are provided with compensation, such as an accumulator or other pneumatic compensation. During this part of the tripping out operation, a communication path is maintained between the communication ring 160 and CWT communication ring 170, optionally with a physical contact therebetween, but may be inductive.

As the drill string is raised, any drilling mud in the stand of drill pipe 13 is allowed to settle at a level close to the drill floor 3 and be replace with air through action of the one-way seal arrangement 175 and/or 190 or through a valve (not shown) in the communication while tripping tool 101.

When a stand of drill pipe, which may be two, three or four lengths of drill pipe have been raised above the rig floor 3, and before unthreading of the stand of drill pipe 13 commences, hydraulic fluid is pumped to the rams 119 to retract the pistons 120 into the cylinders 118 raising the sleeve 110. The stinger 130 extends outwardly from the end of the CWT pin end 125 as the sleeve 110 retracts until the outwardly projecting shoulder 132 hits the end stop shoulder 128 of the CWT pin end 125. The flange 137 lifts off the shoulder 162, moving the communication ring 160 and CWT communication ring 170 from physical touching contact and continues to retract. Full stroke of the rams is optionally 0.75 to 1 m (30 to 40 inches) although may be 0.25 to 3 m. Communication between the drill string 17 and the communication while drilling tool is broken.

The iron roughneck 33 is operated to rotate the stand of drill pipe 13 to unthread the stand 13 from the drill string 17. The stand of drill pipe 13 is free to rotate in the elevator 14.

In the event that the communication while tripping tool remains in the engaged position, the stinger 130 may rotate in concert with the stand of drill pipe 13 within the CWT pin end. Alternatively, the stinger 130 remains static and the stand of drill pipe 13 rotates relative thereto. Alternatively, the main shaft 29 of the top drive 30 rotates freely with the stand of drill pipe 13.

The stand of drill pipe 13 is now set back in a finger board pipe rack 44. This can be accomplished with a single joint elevator, line and winch system 46 or a pipe racker (not shown) which may comprise a robotic arm.

The steps above are repeated until the tripping out operation is concluded.

When tripping in, stands of drill pipe are added to the drill string 17. The top drive apparatus 100 is initially located toward the top of the track 10 in the derrick 2. A stand of drill pipe 45 is pulled from the finger board pipe rack 44 using the single joint elevator, line and winch system 46 or a pine handler (not shown) and moved to well centre, directly above the top of the drill string 17 projecting upwardly from the drill floor 3. The upper end of the stand of drill pipe 45 is placed in the elevator 14 and hangs therefrom.

The iron roughneck 33 is offered up to and grips the tail of the stand 45 and the stem 49 projecting upwardly from the spider 18 in the drill floor 3. The stand of drill pipe 13 is free to rotate in the elevator 14. The iron roughneck 33 threads the pin end of the stand of drill pipe 45 into the box of the stem 49. The slips 36 in the elevator 14 are activated to grip the stand of drill pipe 45, which now forms part of the drill string 17.

The communication while tripping tool 101 is initially in the inactive position as shown in FIG. 3. The communication while tripping tool 101 is activated by flowing hydraulic fluid into a lower chamber of the rams 119 to assume the engaged position shown in FIG. 4. The sleeve 110 moves downwardly along tube 104 until the CWT communication ring 170 in the flange 137 abuts the communication ring 160 in the shoulder 162 at the base of the internal threaded portion 164 of box end 140 and the aforementioned contact force is applied. The spring 131 also facilitates a constant force between the CWT communication ring 170 in the flange 137 and the communication ring 160 in the shoulder 162, facilitating a communication path thereacross.

A stable communication path is now established between the drill string 17 and the communication while tripping tool 101. The communication signal can now pass through the CWT wire 196 to the upper CWT communication ring 199, and on to the ISub 32 or IIBOP 31 which passes on any signals obtained from the wired drill string 17 to a computer 200 on the rig floor 3.

The drawworks 12 is activated to reel in line 9 a small amount, raising the top drive apparatus 100 along track 10 a small distance, lifting the elevator 14 and the drill string 17 held therein and releasing the spider 18 in the elevator 14. The drawworks 12 is activated to reel out line 9, lowering the top drive apparatus 100 along track 10, lowering the elevator 14 and the drill string 17 held therein until a top stem 49 of the drill string 17 is above the rig floor 3. Circulation of drilling mud through the top drive 30, communication while tripping tool 101 and the drill string 17 may be carried out.

When the drill string 17 is lowered into the wellbore 20 and only a stem projects from the well floor 3, the spider 18 engages the drill string 17 to prevent the drill string from falling through the wellbore 20 and the elevator 14 is removed from the stem 49. The top drive apparatus 100 is raised by reeling in line 9. Hydraulic fluid is pumped into an upper chamber of ram 119 to retract piston 120 moving the sleeve 104 into the inactive position shown in FIG. 3.

The steps above are repeated until the tripping in operation is concluded.

Figure 5:
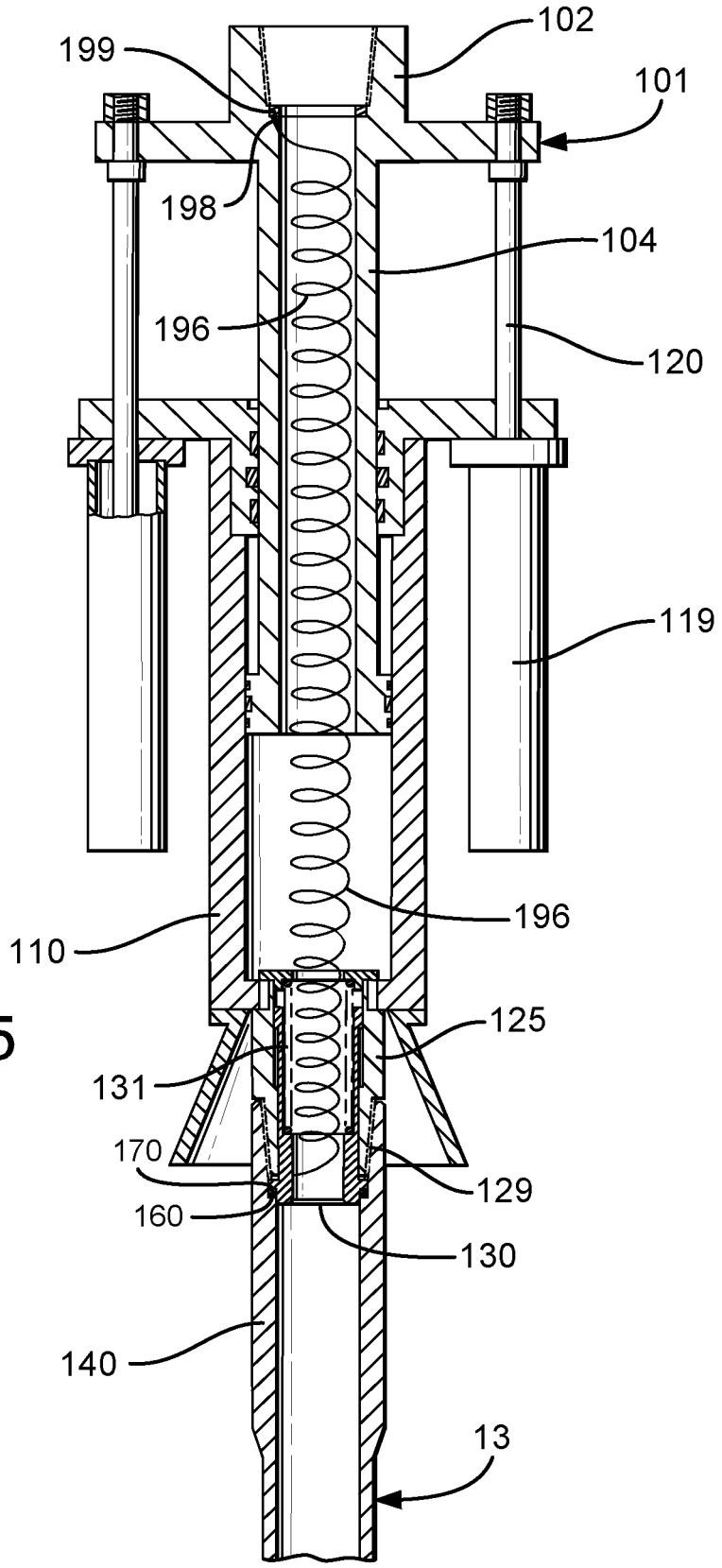
FIG. 5 is a side view in cross-section of the communication while tripping tool shown in FIG. 2, in a well control position in which a threaded connection is made with the wired drill string.
Figure 6:
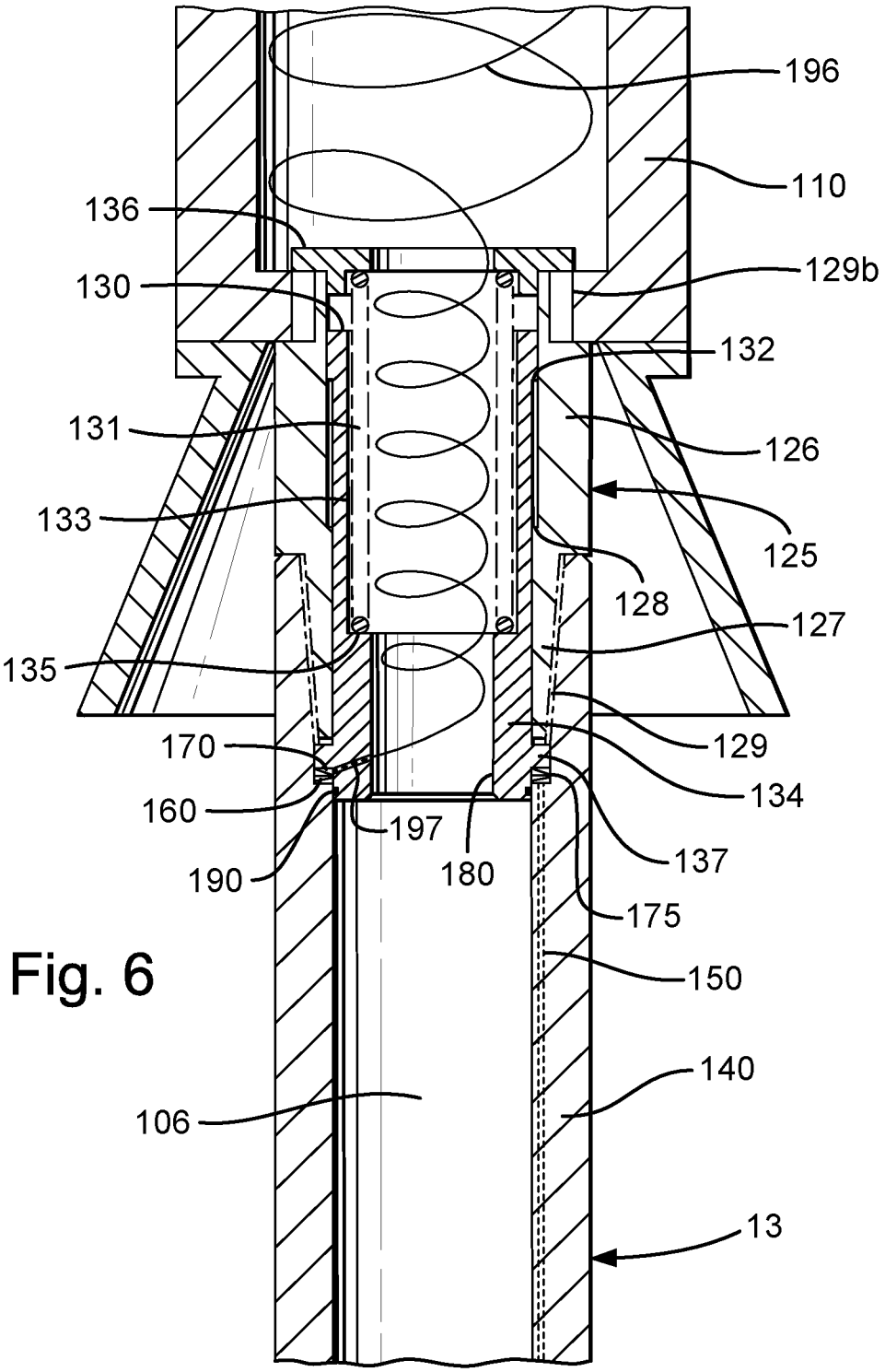
FIG. 6 is an enlarged view of part of the communication while tripping tool shown in FIG. 2, shown in the well control position.

During a well control situation, the tool pusher or driller activates the top drive apparatus 100 to move downwardly, stabbing the CWT pin end 125 into the box end 140. The stinger 130 is inhibited from moving into the bore 106 of the drill pipe by the flange 137, thus the downward movement of the communication while drilling tool pushes the CWT pin end 125 over the stinger 130 against spring 131. The stinger 130 thus retracts into the CWT pin end 125. The top drive 30 in then activated to rotate the main shaft 29 in a clockwise direction, which rotates the communication while tripping tool 101, rotating the pin end 125, spinning and threading the pin end 125 into the box end 140 and then torqueing the connection to the desired torque to obtain a full seal so that the communication while tripping tool assumes a well control position, which is shown in FIGS. 5 and 6. During torqueing the connection, a means is required to react the torque generated by the top drive. The reaction force to the torque generated by the top drive 30 can be taken through the spider 18 in the rig floor 3, or through the pine gripper 40. If the reaction is to be taken through the pipe gripper 40, the pipe gripper 40 is activated to extend the telescopic legs 39 to move the pipe gripper 40 underneath the communication while tripping tool 101 and the pipe gripper activated to grip the drill pipe 13. The full seal across the threaded connection is rated to at least 10,000 psi (700 bar). The seal is optionally maintained at to reduce the likelihood of a well control situation turning into a situation which could have a negative impact on the drilling rig 1. Once a full connection is established, high density drilling mud can be circulated in the drill string 17 to settle the well and/or the IIBOP 31 can be activated to contain drilling fluid in the drill string 17. The full weight of the drill string 17 can be held through the tripping tool 101 load path, which could be in the order of 500 to 1250 tons (450 to 1,130 tonnes), depending on the weight of the string. For the avoidance of doubt, the full weight of the drill string is taken by through the tripping tool 101 without need of the pipe gripper 40. The top drive may be used to push down on the drill string 17, which can also be done across the tripping tool 101. Furthermore, full torque provided by the top drive can be transferred across the tool 101, without need of the pipe gripper 40. Full torque may be in the order of 75,000 ft lbs (102,000 Nm).

An alternative way of making the connection between the CWT pin end 125 and the box end 140, is to activate the rams 119 to stab the CWT pin end 125 into the box end 140 and then use the iron roughneck 33 to spin and torque the CWT pin end 125 and to grip the drill pipe 13 with a back-up-tong. The stabbing guide 195 may have to be removed before offering the iron roughneck 33 up to the CWT pin end 125 and box end 140.

When it is desired to trip-in or trip-out without communication along the drill string 17, the communication while tripping toed 101 assumes its inoperative position as shown in FIG. 3, which allows approximately 0.75 to 1 m gap between the bottom of the communication while tripping tool 101 and the elevator 14 to carry on normal tripping operations.

The pin end 125 may be easily removed from the sleeve 110 and be replaced with a pin end for different diameter drill pipe.

Figure 8:
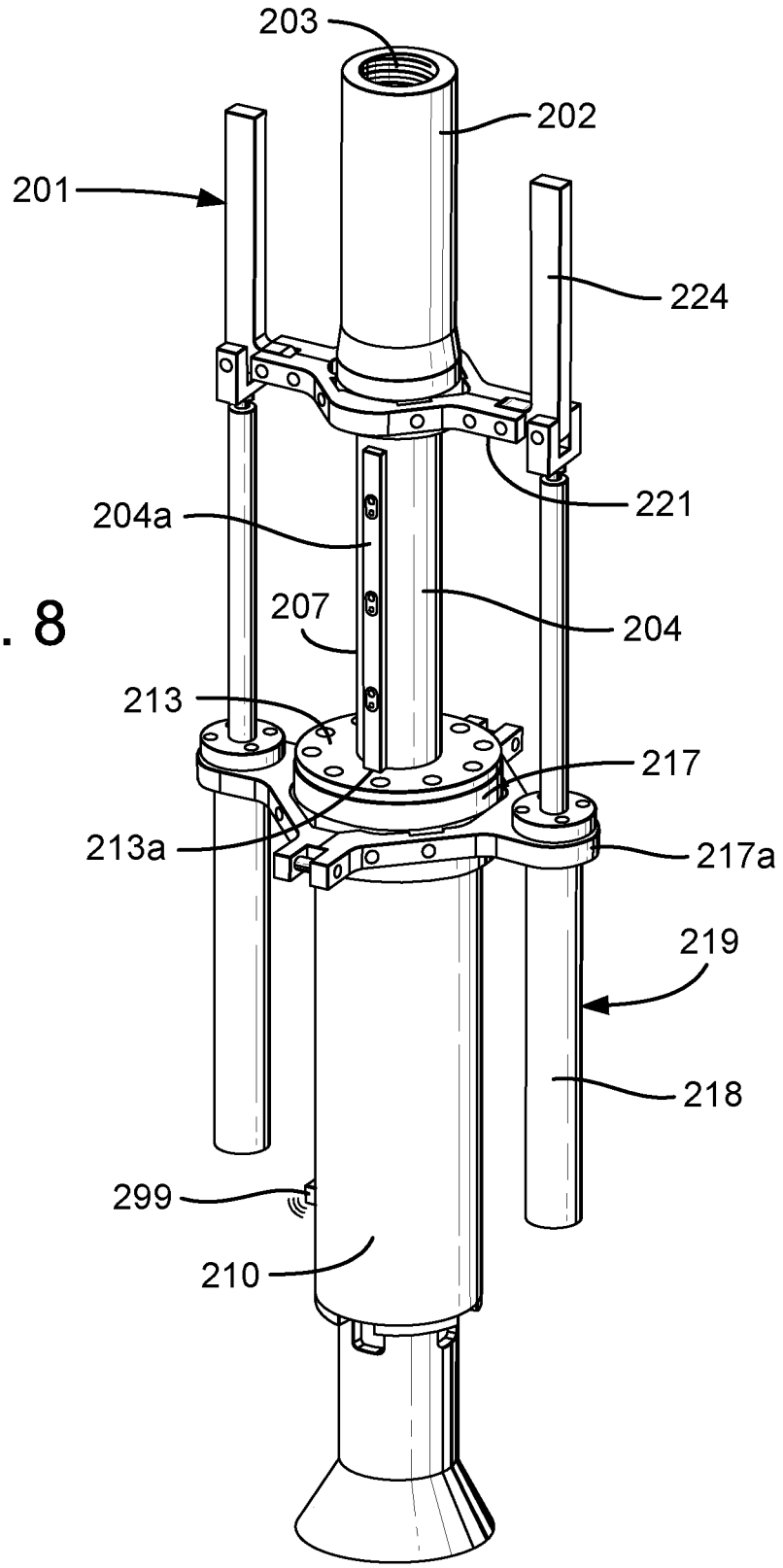
FIG. 8 is a perspective schematic view of a further embodiment of a communication while tripping tool.
Figure 9:
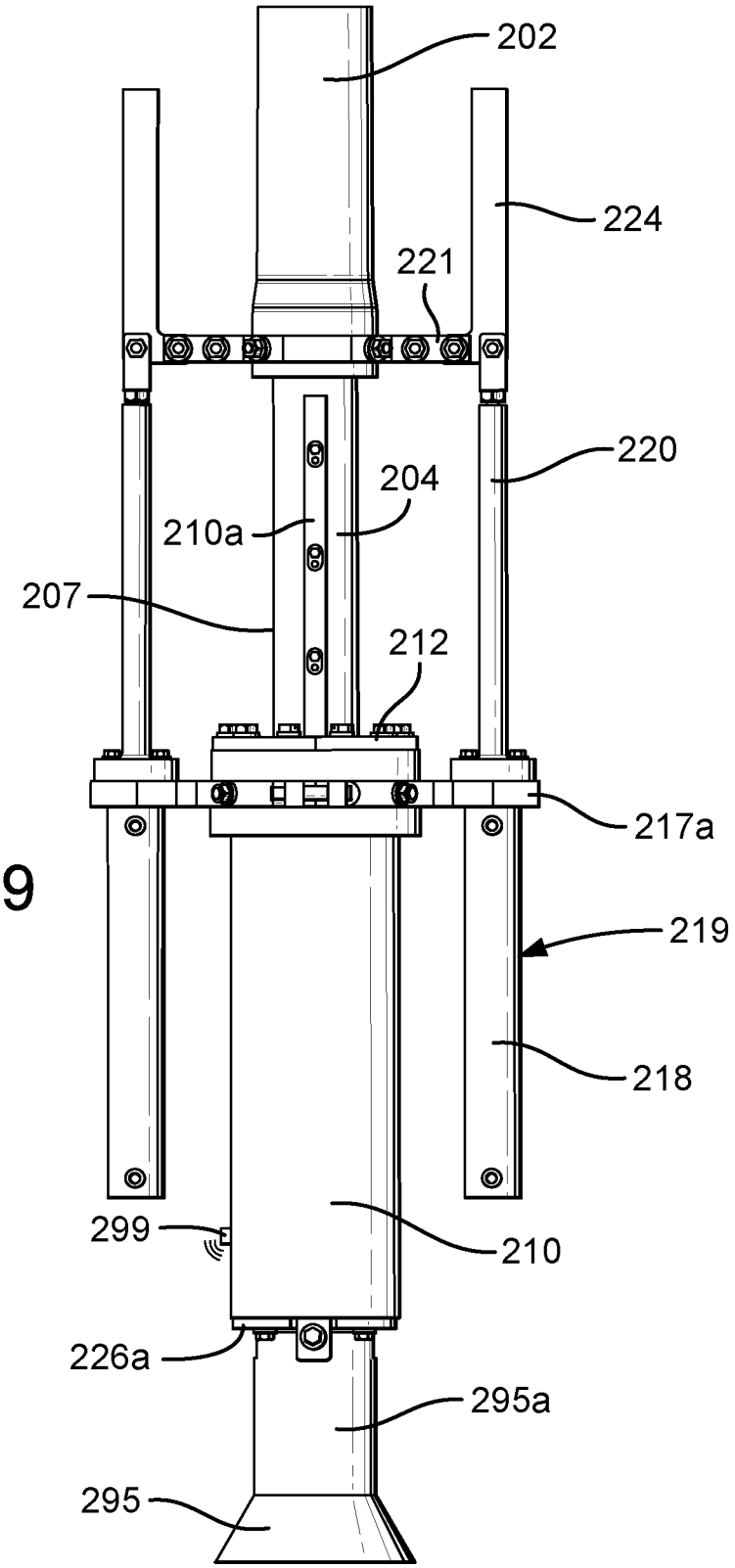
FIG. 9 is a front view of the communication while tripping tool shown in FIG. 8.
Figure 10:
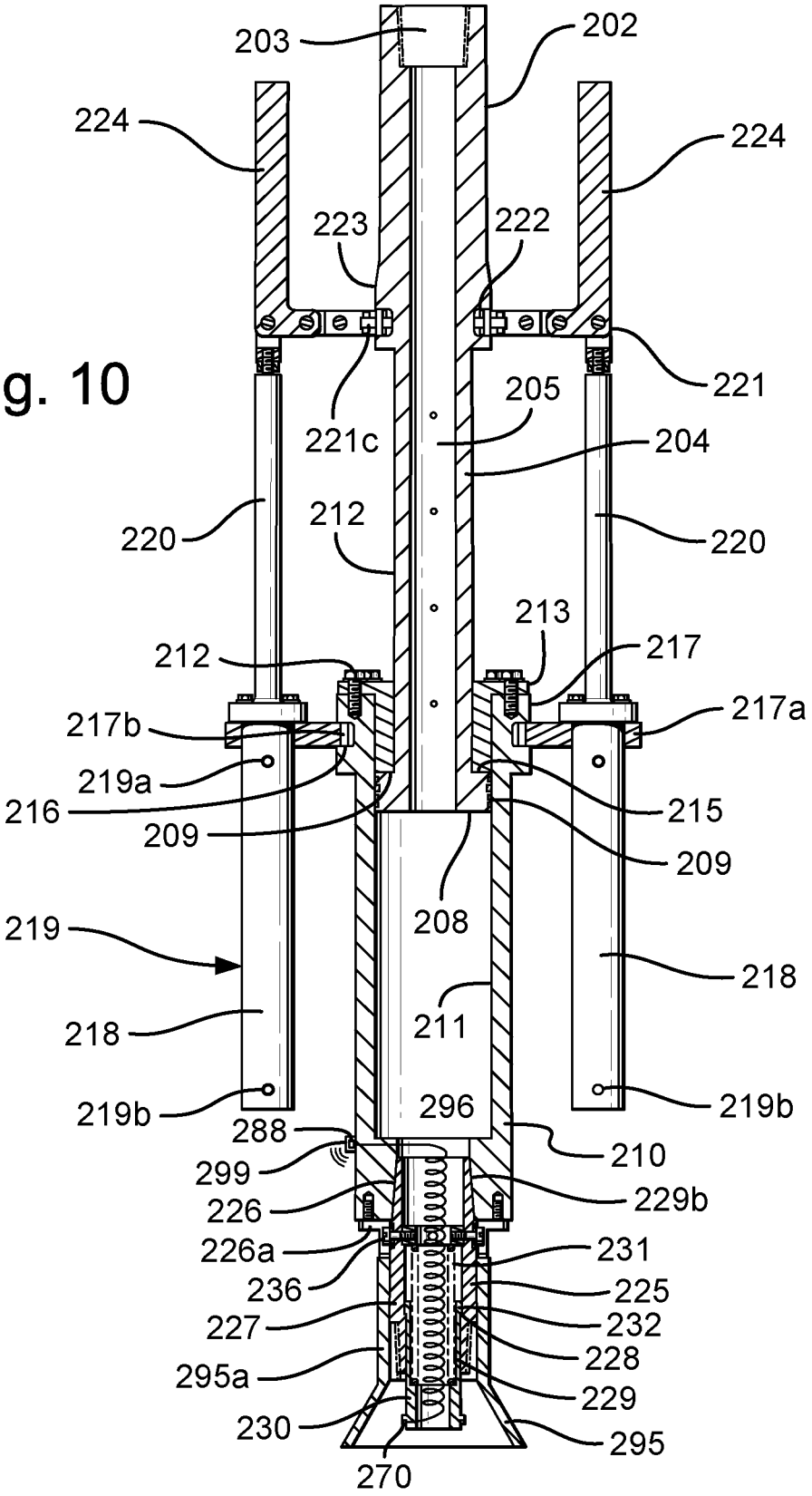
FIG. 10 is a front view partly in section of the communication while tripping tool shown in FIG. 8.

Referring to FIGS. 8 to 10, there is shown a communication while tripping tool 201 which is generally similar to the communication while tripping tool 101, with similar parts identified with the same reference numerals in the two hundred Series. The communication while tripping tool 201 may replace the communication tool 101 in the top drive apparatus 100 with mall alterations set out below.

The communication while tripping tool 201 has a box 202 having a female thread 203 for connection with a threaded pin (not shown) of a main shaft 29, sub (not shown), ISub 32 or IIBOP 31 and depends therefrom. However, only a part of the communication while tripping tool 201 rotates in concert with the main rotor shaft 29 of the top drive 30.

The communication while tripping tool 201 comprises a tube 204 depending from the box 202, which is optionally integral therewith. The tube 204 has an inner surface defining a flow bore 205 which has a cross-sectional area substantially equal to the cross-sectional area of flow bore 106 in the wired drill pipe 13. The tube 204 has a smooth exterior surface 207 having at a lower end, an outwardly extending shoulder 208 having a plurality of recesses with O-ring seals 209 therein.

A sleeve 210 has a smooth inner surface 211 having a top end with a cap 213 axially bolted to the sleeve 210 to inter alia inhibit relative rotation therebetween. The smooth inner surface 211, shoulder 208, smooth outer surface 207 and an end 215 of the cap 213 define an annulus. The cap 213 has a recess **213*a* keyed to match the profile of an axial bar 204*a* to form a spline to inhibit relative rotation between the tube 204 and the sleeve 210. A plurality splines may be provided to inhibit relative rotation between the tube 204 and the sleeve 210**. The spline defines a torque path. Optionally, the torque path is able to withstand a torque sufficient to spin a joint, optionally to torque a joint, optionally to turn the entire drill string and optionally to take the full torque provided by the top drive against a fixed drill string, typically 75,000 ft lbs (102,000 Nm).

A CWT pin end 225 is fixed to a lower end of the sleeve 210. The CWT pin end 225 has an upper threaded end **229*b* threaded and rotationally locked into the lower end of the sleeve 210 with a ring 226*a* axially bolted thereto. The CWT pin end 225 has an upper portion 226 with an internal diameter which is slightly larger than the internal diameter of the wired drill pipe 13. The CWT pin end 225 has a lower portion 227 with an internal diameter which is substantially the same as the internal diameter of the wired drill pipe 13. The CWT pin end 225 has a shoulder 228 formed between the upper portion 226 and lower portion 227. The lower portion 227 also has a tapered external surface provided with a male thread 229**.

A stinger 230 is slideably arranged in the CWT pin end 225 against a coiled spring 231. The stinger 230 takes the form of a sleeve slideably projecting from the end of the pin end 225. The stinger 130 has an upper end having an outwardly projecting shoulder 232, which abuts and slides along the internal surface of the upper portion 226 of the CWT pin end 225. A spring retainer 236 is fixed to the ring 226*a* below the sleeve 210 in the pin end 225, against which an upper end of the coiled spring 231 is biased.

A frusto-conical stabbing guide 295 has a cylindrical portion 295*a* which covers the CWT pin end 225. The frusto conical portion of the stabbing guide 295 flares outwardly substantially in line with the bottom of the thread 229 and extends below the stinger 230 to facilitate guiding the stinger 230 into box end 140 of drill pipe 13.

A transmitter/receiver 298 is provided in a box 299 strapped to sleeve 210. The transmitter/receiver 298 is hard wired with wire 296 to the communication ring 270 in flange 237 of the stinger 230. The transmitter/receiver 298 sends and receives signals wirelessly to a corresponding transmitter/receiver 300 on the rig floor 3, which is connected to computer 200.

The method of operation is identical to the method for the communication while tripping tool 101. It will be noted that the rams 219 and collar 217*a* and upper collar 221 remain rotationally static while the rest of the communication while tripping tool rotates in concert with the main shaft 29.

The invention claimed is:

1. A top drive apparatus for facilitating communication between a computer apparatus and a device in a drill string, the drill string comprising a pipe having a threaded box end and a pipe communication element therein, the top drive apparatus comprising a top drive having a main shaft and a tool rotationally coupled therewith, the tool comprising a threaded pin end having a tool communication element projecting from the threaded pin end sufficient that the threaded pin end and threaded box end do not have to be made up to obtain a communication between the pipe communication element and the tool communication element.

2. The top drive apparatus as claimed in claim 1, wherein the tool further comprises a resilient member arranged to bias said tool communication element away from the pin end.

3. The top drive apparatus as claimed in claim 1, wherein said tool communication element is arranged on a stinger having a flow bore for allowing drilling mud to flow therethrough.

4. The top drive apparatus as claimed in claim 3, wherein said stinger has a flange, said tool communication element arranged in said flange.

5. The top drive apparatus as claimed in claim 3, wherein said stinger has a lower portion insertable into the bore of said threaded box end of said pipe.

6. The top drive apparatus as claimed in claim 3, wherein said stinger comprises at least one seal for inhibiting drilling mud escaping said flow bore between said stinger and said threaded box end of said pipe.

7. The top drive apparatus as claimed in claim 6, wherein said seal is an axial seal.

8. The top drive apparatus as claimed in claim 6, wherein said seal is an annular seal.

9. The top drive apparatus as claimed in claim 6, wherein said tool further comprises a pressure release means for allowing air into said flow bore when pressure therein is lower than atmospheric pressure.

10. The top drive apparatus as claimed in claim 1, wherein the tool communication element is retractable relative to the pin end.

11. The top drive apparatus as claimed in claim 1, wherein said tool further comprises a tube and a sleeve telescopically slideable relative to one another, said pin end depending from said sleeve, said tube and sleeve providing a flow path between the main shaft and the drill string.

12. The top drive apparatus as claimed in claim 11, wherein said tool further comprises an axial retraction apparatus to move the pin end relative to the top drive.

13. The top drive apparatus as claimed in claim 12, wherein said axial retraction apparatus is arranged between upper and lower stators, wherein said upper stator comprises an upper collar, the tube rotatably arranged therein, and wherein said lower stator comprises a lower collar, the sleeve rotatably arranged therein.

14. The top drive apparatus as claimed in claim 1, wherein the tool further comprises a wireless transmitter and/or receiver wired to said tool communicating element for facilitating transmission and/or reception of data from said computer to and/or from said drill string.

15. The top drive apparatus as claimed in claim 1, wherein said tool communication element is a ring and wherein said pipe communication element is a ring.

16. The top drive apparatus as claimed in claim 1, wherein a box end of said tool is arranged at the top of the tool, the top drive apparatus further comprising a further tool communication element and a wire between said tool communication element and said further tool communication element for facilitating communication therebetween.

17. The top drive apparatus as claimed in claim 1, wherein the top drive apparatus further comprises an Internal Blow Out Preventer between said main shaft-and said tool.

18. A tool connectable to a top drive apparatus, the tool comprising a threaded pin end having a flow bore therethrough and a tool communication element projecting from the threaded pin end on a stinger having a flow bore for allowing drilling mud to flow therethrough, said stinger comprising at least one seal for inhibiting drilling mud escaping said flow bore between said stinger and a box end of a pipe in which said stinger is to be inserted.

19. The tool as claimed in claim 18, wherein the tool further comprises a resilient member arranged to bias said tool communication element away from the pin end.

20. The tool as claimed in claim 19, wherein said stinger has a flange, said tool communication element arranged in said flange.

21. A method for facilitating communication between a computer apparatus and a downhole device in a drill string during tripping, the method comprising the steps of:

moving a threaded pin end having a flow-bore towards a threaded box end of a drill string, the threaded box end having a pipe communication element therein, and the threaded pin end having a tool communication element projecting therefrom; and transferring data between the pipe communication element and the tool communication element without making a threaded connection therebetween and maintaining flow of drilling mud through said threaded pin end and said drill string.

22. The method in accordance with claim 21, wherein the tool communication element is fixed to a stinger which is axially movable relative to the pin end, the method further comprising the step of circulating mud through the stinger and the drill string.

23. The method in accordance with claim 21, wherein in a well control operation, the pin end is made up to the box end of the drill string, and transferring data between the pipe communication element and the tool communication element.

24. A top drive apparatus for facilitating communication between a computer apparatus and a device in a drill string, the drill string comprising a pipe having a threaded box end and a pipe communication element therein, the top drive apparatus comprising a top drive having a main shaft and a tool rotationally coupled therewith, the tool comprising a threaded pin end having a tool communication element, wherein the tool communication element is retractable relative to the pin end.

25. A top drive apparatus for facilitating communication between a computer apparatus and a device in a drill string, the drill string comprising a pipe having a threaded box end and a pipe communication element therein, the top drive apparatus comprising a top drive having a main shaft and a tool rotationally coupled therewith, the tool comprising a threaded pin end having a tool communication element, wherein the tool further comprises a resilient member arranged to bias the tool communication element away from the pin end.

26. A top drive apparatus for facilitating communication between a computer apparatus and a device in a drill string, the drill string comprising a pipe having a threaded box end and a pipe communication element therein, the top drive apparatus comprising a top drive having a main shaft and a tool rotationally coupled therewith, the tool comprising a threaded pin end having a tool communication element, wherein the tool communication element is arranged on a stinger having a flow bore for allowing drilling mud to flow therethrough.

* * * * *